US009252525B2

(12) United States Patent
Mann et al.

(10) Patent No.: US 9,252,525 B2
(45) Date of Patent: Feb. 2, 2016

(54) SEALING CONNECTOR TO MITIGATE CORROSION

(71) Applicant: GLOBALFOUNDRIES INC., Grand Cayman, KY (US)

(72) Inventors: Phillip V. Mann, Rochester, MN (US); Mark D. Plucinski, Rochester, MN (US); Sandra J. Shirk/Heath, Rochester, MN (US); Arvind K. Sinha, Rochester, MN (US)

(73) Assignee: GLOBALFOUNDRIES INC., Grand Cayman (KY)

( * ) Notice: Subject to any disclaimer, the term of this patent is extended or adjusted under 35 U.S.C. 154(b) by 134 days.

(21) Appl. No.: 13/967,545

(22) Filed: Aug. 15, 2013

(65) Prior Publication Data

US 2015/0050823 A1 Feb. 19, 2015

(51) Int. Cl.
*H01R 13/52* (2006.01)

(52) U.S. Cl.
CPC ..... *H01R 13/5219* (2013.01); *H01R 13/5216* (2013.01)

(58) Field of Classification Search
CPC . H01R 13/523; H01R 11/281; H01R 13/5216
USPC ..... 439/198, 519, 521
See application file for complete search history.

(56) References Cited

U.S. PATENT DOCUMENTS 3,243,758 A * 3/1966 Frant et al. ..... 439/519
3,643,207 A * 2/1972 Cairns ..... 439/201
3,714,384 A * 1/1973 Burkhardt et al. ..... 200/51 R
3,972,581 A * 8/1976 Oldham ..... 439/201
4,295,701 A 10/1981 Gunn
4,425,017 A * 1/1984 Chan ..... 439/276
4,669,792 A * 6/1987 Kjeldstad ..... 439/38
5,957,715 A 9/1999 Fukuda
5,975,945 A * 11/1999 Daoud ..... 439/519
5,980,278 A 11/1999 Winkler
6,547,581 B2 4/2003 Zweigle et al.
6,979,225 B2 * 12/2005 Solano ..... 439/519
7,140,897 B2 11/2006 Axenbock et al.
7,150,638 B1 12/2006 Fonville et al.
7,563,113 B2 7/2009 Sheng (Continued)

FOREIGN PATENT DOCUMENTS

EP 01050556 A2 8/1985
EP 2434591 A1 3/2012

(Continued)

*Primary Examiner* — Hae Moon Hyeon
(74) *Attorney, Agent, or Firm* — Thompson Hine LLP

(57) ABSTRACT

An electrical connector system for mitigating corrosion and maintaining an internal environment conducive for connectivity and the protection of internal electrical contacts is disclosed. The electrical system can include a female connector device designed to couple with a male connector device, and to enclose a chamber containing a corrosion deterring fluid. One or more electrical contacts can be located within the chamber, and be configured to interface with connecting members of a male connector device. The electrical connector system can also include one or more sealing gates configured to act as a sealing membrane that is designed to separate the corrosion deterring fluid in the chamber from fluid external to the chamber while allowing the connecting members of the male connector device to be inserted through the gates and into the chamber.

16 Claims, 6 Drawing Sheets

(56) References Cited

U.S. PATENT DOCUMENTS

| | | | | |
|---|---|---|---|---|
| 7,736,165 | B2 * | 6/2010 | Bukovnik et al. | 439/276 |
| 2005/0124191 | A1 | 6/2005 | Stanton et al. | |

FOREIGN PATENT DOCUMENTS

| | | | |
|---|---|---|---|
| WO | 2006047672 | A1 | 5/2006 |
| WO | 2007032816 | A2 | 3/2007 |

* cited by examiner

SEALING CONNECTOR TO MITIGATE CORROSION

TECHNICAL FIELD

The present disclosure generally relates to an electrical connector with at least one electrical contact for electrically contacting a corresponding input connector. In particular, it relates to an electrical connector device capable of maintaining an internal environment conducive for connectivity and the protection of internal electrical contacts.

BACKGROUND

The metallic materials that compose electrical connectors in use today can be susceptible to oxidation and other types of corrosion, particularly in environments with poor air quality, harsh climates, or severe weather conditions. Such corrosion can lead to decreased electrical conductivity in the metals, diminished signal integrity in communications between the electrical contacts, and impaired performance of the connector's functions.

SUMMARY

Aspects of the present disclosure are directed to systems and structures for use in electrical connectors to deter corrosion, and methods of using, that address challenges including those discussed herein, and that are applicable to a variety of applications. These and other aspects of the present invention are exemplified in a number of implementations and applications, some of which are shown in the figures and characterized in the claims section that follows.

Aspects of the disclosure, in certain embodiments, are directed toward an electrical connector system capable of maintaining an internal environment conducive for connectivity and the protection of internal electrical contacts. In certain embodiments, the electrical connector system can include a female connector device having an outer casing defined by a top and bottom wall, a rear wall, and a pair of side walls. The female connector device can be designed to enclose a chamber containing a corrosion deterring fluid and to couple with a male connector device. The female connector device can have one or more electrical contacts within the chamber that are configured to interface with connecting members of a male connector device. In certain embodiments, the female connector device can include one or more sealing gates configured to act as a sealing membrane that is designed to separate the corrosion deterring fluid in the chamber from fluid external to the chamber while allowing the connecting members of a male connector device to be inserted through the gates and into the chamber.

Aspects of the disclosure, in certain embodiments, are directed toward a male connector device designed to couple with a female connector device and to enclose a chamber containing a corrosion deterring fluid. The male connector device can include an outer casing defined by a top and bottom wall, a rear wall, and a pair of side walls. In certain embodiments, the male connector device can include one or more connecting members having a proximal end and a distal end, the proximal end attached to the rear wall within the outer casing, and the connecting members being of a length such that the distal end is recessed relative to the top, bottom and side walls of the outer casing. In certain embodiments, the male connector device can include one or more sealing gates configured to act as a sealing membrane that is designed to separate the corrosion deterring fluid in the chamber from fluid external to the chamber while allowing the connecting members of the male connector device to be inserted into a female connector device.

Aspects of the disclosure, in certain embodiments, are directed toward an electrical connector system for protecting internal components of a female connector device and a male connector device. In certain embodiments, the electrical connector system can include a female connector device having a first outer casing defined by a top and bottom wall, a rear wall, and a pair of side walls. The female connector device can be designed to enclose a first chamber containing a corrosion deterring fluid and to couple with a male connector device. The female connector device can have one or more electrical contacts within the first chamber that are configured to interface with connecting members of the male connector device. Consistent with various embodiments, the female connector device can include a first set of one or more sealing gates configured to act as a sealing membrane that is designed to separate the corrosion deterring fluid in the first chamber from fluid external to the first chamber while allowing the connecting members of the male connector device to be inserted through the first set of one or more sealing gates and into the first chamber.

In certain embodiments, the electrical connector system can include a male connector device designed to couple with a female connector device and to enclose a second chamber containing a corrosion deterring fluid. The male connector device can include a second outer casing defined by a top and bottom wall, a rear wall, and a pair of side walls. Consistent with various embodiments, the male connector device can include one or more connecting members having a proximal end and a distal end, the proximal end attached to the rear wall within the second outer casing, and the connecting members being of a length such that the distal end is recessed relative to the top, bottom and side walls of the second outer casing. In certain embodiments, the male connector device can include a second set of one or more sealing gates configured to act as a sealing membrane that is designed to separate the corrosion deterring fluid in the second chamber from fluid external to the second chamber while allowing the connecting members of the male connector device to be inserted into a female connector device.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments of the invention and do not limit the disclosure.

Figure 1:
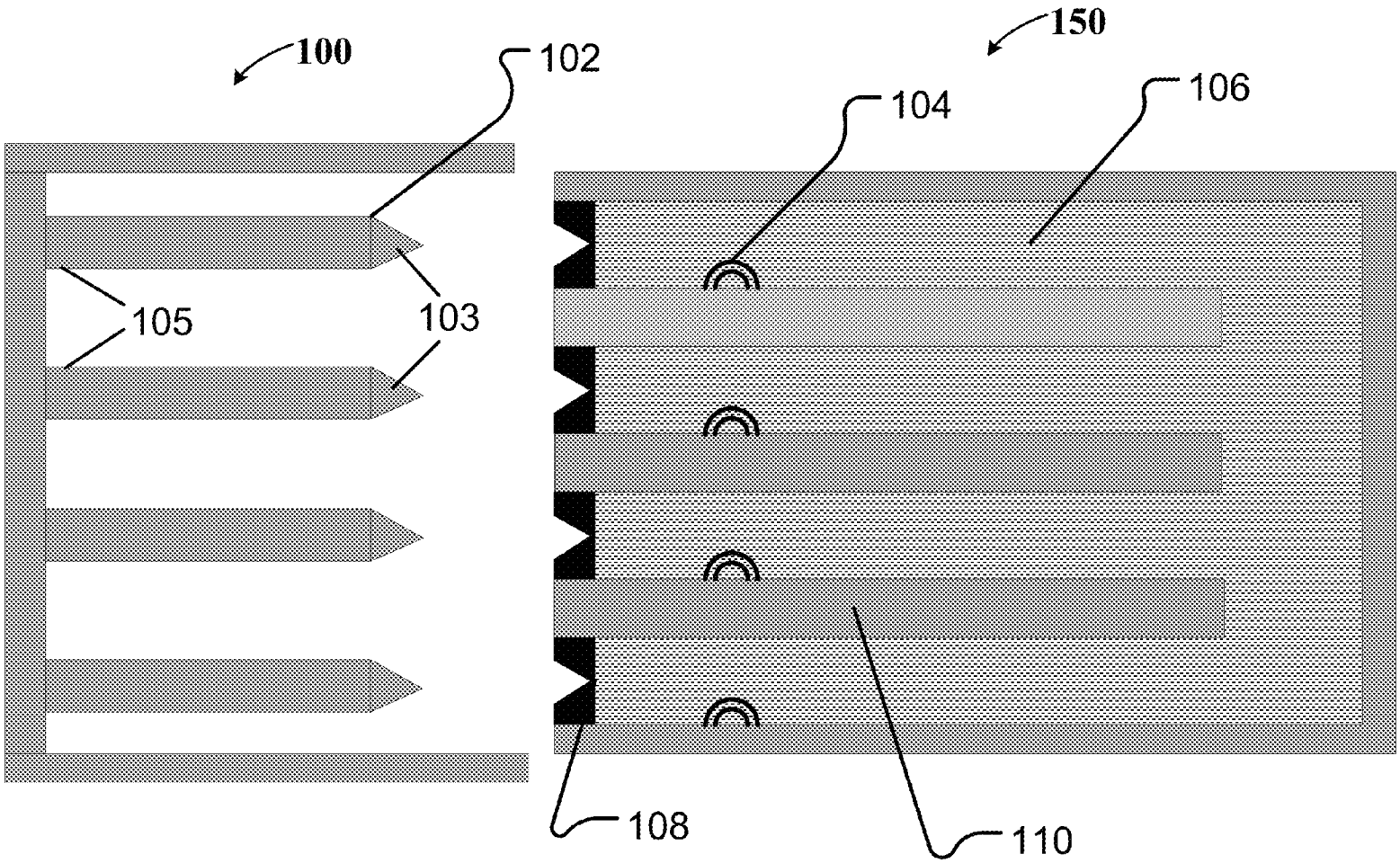
FIG. 1 is a side view of the male connector device and female connector device of the electrical connector in an uncoupled state, consistent with embodiments of the present disclosure.

While aspects of the present disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Aspects of the present disclosure relate to various embodiments and methods for aiding in the deterrence of corrosion of electrical terminals, more particular aspects relate to an electrical connector system having a male connector device and a female connector device that can contain a corrosion deterring fluid that protects the electrical contacts and facilitates the function of the connector system in various environments. While the present disclosure is not necessarily limited to such applications, various aspects of the invention may be appreciated through a discussion of various examples using this context.

Aspects of the present disclosure relate to an electrical connector system capable of maintaining an internal environment that is conducive for quality connectivity and for the protection of internal electrical contacts. For instance, embodiments of the present disclosure are directed toward a connector having a female connector device that contains a corrosion deterring fluid. The corrosion deterring fluid can be a liquid or gas having the free-flowing properties of a fluid and also having corrosion deterring properties. For example, in certain embodiments, the corrosion deterring fluid can be nitrogen gas. The corrosion deterring fluid can provide protection for the electrical contacts and can facilitate the functions of the connector system in various external environments. The connector system can include an arrangement of sealing gates that allows for interfacing between the female connector device and a male connector device while impeding leakage of the corrosion deterring fluid.

In various embodiments, the corrosion deterring fluid resides in the female connector device whether or not a coupled male connector device is engaged therewith. Consistent with various aspects, one or more entrances can allow for the coupling male connector device to be engaged in this manner. For instance, an entrance can include a deformable seal for each connecting member (e.g., each pin) of the male connector device. In certain embodiments, the female connector device can include one or more entrances. For example, it can include connector entrances for coupling with male connector devices, and compartment entrances for interfacing with peripheral chambers, which can function as a reservoir for the corrosion deterring fluid.

In various embodiments, the corrosion deterring fluid can reside in both a chamber of the female connector device and within the housing of a coupling male connector device. Here, both the female connector device as well as the male connector device can have one or more deformable seals that enable coupling of the male connector device with the female connector device without allowing leakage of the corrosion deterring fluid.

In various embodiments, the corrosion deterring fluid is initially contained within a separate storage compartment attached to the female connector device. A valve can be located at the storage compartment entrance that can be configured to actuate when a male connector device couples with the female connector device, and release the corrosion deterring fluid.

Turning now to the figures, FIG. 1 shows a side view of a male connector device 100 and a female connector device 150 of an electrical connector system in an uncoupled state, consistent with embodiments of the present disclosure. Aspects of FIG. 1 are directed toward an electrical connector system capable of maintaining an internal environment that facilitates protection of internal electrical components (e.g., from corrosion). A female connector device 150 can be configured to receive a male connector device 100. Consistent with various embodiments, the male connector device 100 can include at least one connecting member 102 configured to interface with at least one internal electrical contact 104 present in the female connector device 150. Each of the at least one connecting members 102 shown in FIG. 1 has a corresponding distal end 103 and a corresponding proximal end 105. In certain embodiments, the connecting members 102 can include electrical pins; however, other connecting members are possible including, but not necessarily limited to plugs, prongs, and wires. Other shapes and connecting member types are also possible.

Aspects of the present disclosure may be used for a variety of connector systems in which the insertion of a male connector device 100 interfaces with a female connector device 150. Further, principles of the present disclosure can allow for more than one male connector device 100 to couple with a female connector device 150.

Consistent with various embodiments, the electrical contacts 104 can be located on a support surface 110. In certain embodiments, the support surface 110 can be part of a scaffold structure with parallel arms, each upholding at least one electrical contact 104. In certain embodiments, the support surface 110 can be attached to one or more walls of the female connector device 150. For example, the scaffold structure can be affixed to the side walls of the female connector device 150 such that it guides the connecting members 102 to the electrical contacts 104 when a male connector device 100 interfaces with the female connector device 150.

Consistent with various embodiments, the female connector device 150 can enclose a chamber containing a corrosion deterring fluid 106. The corrosion deterring fluid 106 can be a liquid or gas having the free-flowing properties of a fluid and also having corrosion deterring properties. For example, in certain embodiments, the corrosion deterring fluid 106 can be nitrogen gas. Depending on the specific application of the electric connector system, different concentrations of nitrogen gas can be utilized. In certain embodiments, the concentration of nitrogen is 100%. In certain embodiments, the concentration of nitrogen can be between 90%-99%. In certain embodiments the concentration of nitrogen can be at least 80%. Other concentrations are also possible.

According to various embodiments, it is recognized that oxygen gas can cause corrosion problems in concentrations as little as 40 to 50 parts per billion. Accordingly, high concentrations of nitrogen gas can have positive effects on the deterrence of corrosion by displacing oxygen and lowering the concentration thereof. Moreover, atmospheric contaminants such as sulfur can mix with oxygen, which may cause corrosive effects that differ from a single corrosive agent (such as oxygen alone).

The effectiveness of corrosion deterring fluids, such as nitrogen, can vary depending on the surrounding environmental temperature. For instance, higher environmental temperatures can impair nitrogen's rate of corrosion resistance. In certain applications, it may be advantageous to utilize other corrosion deterring fluids. For example, consistent with various embodiments, the corrosion deterring fluid can be helium, neon, argon, xenon, krypton, nitrogen, or a combination thereof. In certain embodiments, the corrosion deterring fluid can be selected based upon a variety of parameters, such as the type of corrosion, the environmental temperature, the cost, or other factors. The fluids or combinations thereof as described herein can facilitate corrosion prevention in a variety of applications.

Consistent with various embodiments, the female connector device 150 can include an arrangement of sealing gates 108 configured to allow the connecting members 102 to be inserted through the sealing gates 108 and into the chamber, and surround the connecting members 102 in a sealing engagement to prevent the corrosion deterring fluid 106 from exiting the chamber. In certain embodiments, the sealing gates 108 can be composed of a deformable material that allows for penetration by the connecting members 102. For example, in some embodiments, the sealing gates 108 can be composed of latex. In certain embodiments, the sealing gates 108 can be composed of a plurality of segments configured to separate to allow the connecting members 102 to pass through and be inserted into the female connector device 150.

Figure 2:
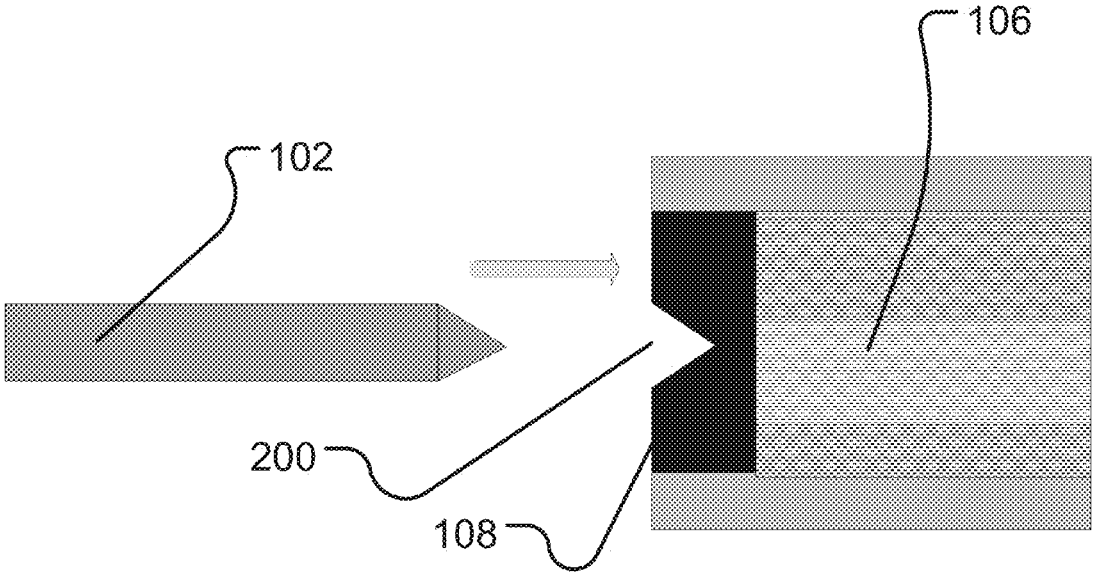
FIG. 2 is an expanded view of a sealing gate architecture of an electrical connector, consistent with embodiments of the present disclosure.

FIG. 2 is an expanded view of the sealing gate architecture of the female connector device, consistent with embodiments of the present disclosure. Aspects of FIG. 2 are directed toward an architecture of sealing gates configured to allow coupling between a male connector device and a female connector device while impeding leakage of a corrosion deterring fluid 106. In certain embodiments, the sealing gate 108 can be composed of a deformable material that allows a connecting member 102 to be inserted through the sealing gate 108, and surround the connecting members 102 in a sealing engagement to prevent leakage of the corrosion deterring fluid 106. Embodiments are directed toward a sealing gate 108 that can have deformable properties that allow a connecting member 102 to be inserted while impeding the release or leakage of the corrosion deterring fluid 106. For instance, the sealing gate 108 can be constructed using one or more of substances including, but not necessarily limited to, gels, rubber, or deformable foam material. For example, in certain embodiments, the sealing gate can be composed of latex.

Consistent with various embodiments, the sealing gate 108 can include multiple layers of deformable material that can be placed along the path of a connecting member 102 as the male connector device and female connector device are brought together. This configuration can be useful for further impeding leakage of the corrosion deterring fluid 106 when the connecting members 102 interface with the female connector device by limiting the amount of external air, or other fluid, that can enter the chamber.

Consistent with various embodiments, the sealing gate 108 can be equipped with a guide notch 200 configured to direct the connecting members 102 through the sealing gate 108. For instance, the guide notch 200 can have a conical shape configured to accommodate the shape of the head of the connecting member 102, and guide it through the sealing gate 108. Other shapes and guide notch solutions are also possible.

Figure 3A:
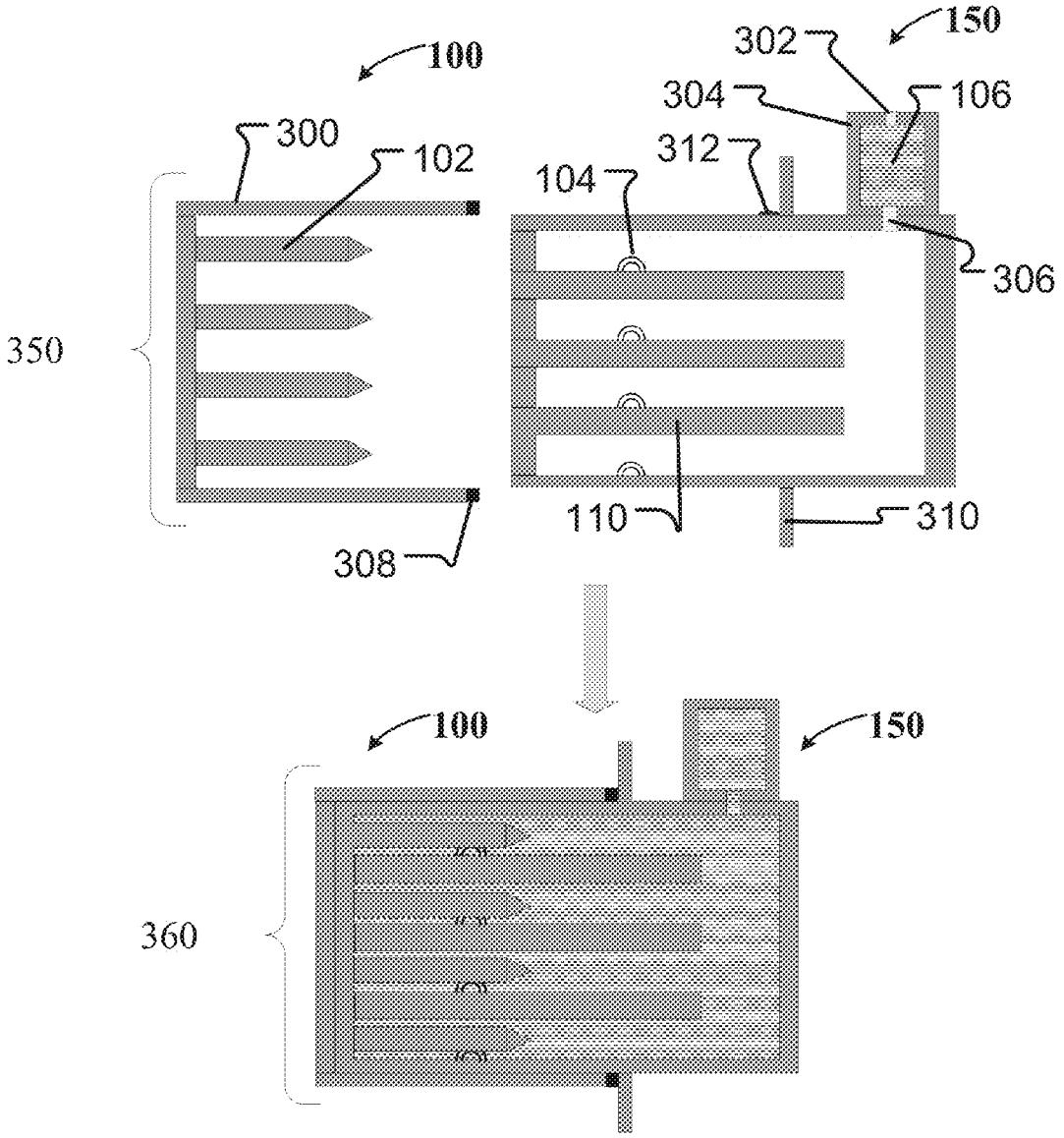
FIG. 3A is a side view of an electrical connector assembly in both separated and mated states, consistent with embodiments of the present disclosure.

FIG. 3A is a side view of an electrical connector system in both a separated state 350 and a mated state 360, consistent with embodiments of the present disclosure. Although the female connector device 150 can effectively retain the corrosion deterring fluid 106 in a variety of environments, it is understood that in certain instances, such as after a long period of use, some of the corrosion deterring fluid 106 may leak or otherwise be depleted from within the female connector device 150. For instance, this leakage may occur when the male connector device 100 and the female connector device 150 are repeatedly connected and disconnected. Various embodiments of the present disclosure are directed toward the repletion of the corrosion deterring fluid 106 within the chamber of the female connector device 150. For instance, aspects of FIG. 3A are directed toward an electrical connector device that includes a separate storage compartment 304 that can be used to store the corrosion deterring fluid 106. The corrosion deterring fluid 106 can be deployed into the female connector device 150 in order to fill or replenish the chamber, and thereby facilitate protection of the internal electrical contacts 104 located on the support surface 110.

In certain embodiments, the storage compartment 304 can be attached to the female connector device 150. The storage compartment 304 can include a release valve 306 configured to deploy the corrosion deterring fluid 106 into the female connector device 150 when the male connector device 100 is fully coupled with the female connector device 150. For instance, the coupling of the male connector device 100 to the female connector device 150 can depress a triggering switch 312 that opens the release valve 306. Consistent with various embodiments, the release valve 306 can be a mechanical valve (e.g., a lever or rotating knob) configured to deploy the corrosion deterring fluid 106 when the male connector device 100 is fully coupled with the female connector device 150. Other valve solutions are also possible.

Consistent with various embodiments, the storage compartment 304 can include a refill port 302 for repletion of the corrosion deterring fluid 106. In certain embodiments, the refill port 302 can be connected to an external supply of the corrosion deterring fluid 106 and refilled manually by an operator. In certain embodiments, the refill port 302 can be connected to an external supply of the corrosion deterring fluid 106 and be replenished (periodically or as necessary) by an automated process. For instance, the storage compartment 304 could be configured to be refilled automatically when the quantity of corrosion deterring fluid 106 within the storage compartment 304 has decreased by an appreciable amount, or periodically after a certain length of time has elapsed. Further, the storage compartment 304 could be configured to be refilled automatically when the electrical connector system powers down or up.

Consistent with various embodiments, the male connector device's outer casing 300 can be equipped with a sealing gasket 308 that is configured to interface with a flange 310 extending from and surrounding the female connector device 150. The interface can create an airtight (hermetic) seal when the male connector device 100 is fully coupled with the female connector device 150. In various embodiments, the sealing gasket 308 and flange 310 can feature a coupling mechanism to ensure a tight seal. For instance, they can be angled to fit snugly, feature interlocking grooves, latches, screws and combinations thereof. These configurations can be useful for creating a hermetic seal and further impeding leakage of the corrosion deterring fluid 106. Other coupling solutions and various combinations of the mechanisms described herein are also possible.

Figure 3B:
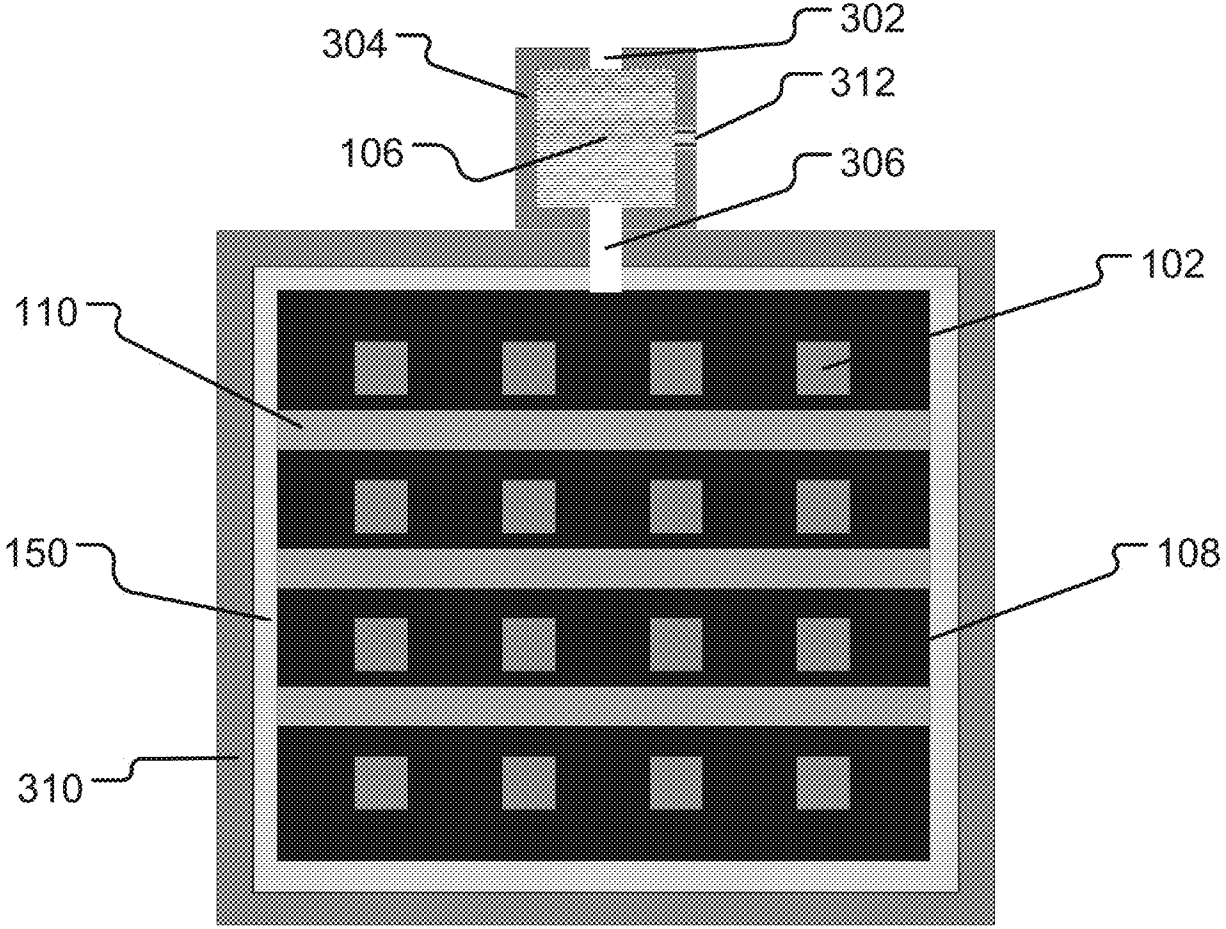
FIG. 3B is a frontal, cross-sectional view of a female connector device of an electrical connector, consistent with embodiments of the present disclosure.

FIG. 3B is a frontal, cross-sectional view of the female connector device 150 of the electrical connector, consistent with embodiments of the present disclosure. Aspects of FIG. 3B are directed toward an electrical connector system that includes a separate storage compartment 304 that can be used to store the corrosion deterring fluid 106. The corrosion deterring fluid 106 can be deployed into the female connector device 150 to facilitate protection of the internal electrical contacts. In certain embodiments, the storage compartment 304 is attached to the female connector device 150. The storage compartment 304 can include a release valve 306 configured to deploy the corrosion deterring fluid 106 into the female connector device 150 when the male connector device is fully coupled with the female connector device 150.

Consistent with various embodiments, the female connector device 150 and the male connector device can include one or more sealing gates 108 that can be configured to act as a sealing membrane separating the corrosion deterring fluid 106 in the chamber from fluid external to the chamber while allowing the connecting members of the male connector device to be inserted through the sealing gates 108 and into the chamber. For instance, the sealing membrane that is formed by a sealing gate 108 can provide a hermetic seal when the female connector device 150 is not in use. The sealing membrane can separate to allow the entrance of a connecting member 102, while forming a seal around the connecting member 102.

Consistent with various embodiments, the connecting members 102 can be configured in an array. For example, in certain embodiments, the connecting members 102 can be configured in a 4×4 array such that each connecting member 102 passes through a sealing gate 108 to interface with an electrical contact located on a support surface 110 within the female connector device 150. The particular size and configuration of the array can be varied according to the particular application (e.g., to conform with industry standards).

Consistent with various embodiments, the female connecting device 150 can be equipped with a flange 310 extending from and surrounding the female connector device 150 to create an airtight seal when the male connector device is fully coupled with the female connector device 150. Although depicted in FIG. 3B as a quadrilateral cross section, the flange 310 can be designed in a variety of shapes to meet the needs of different applications. For example, in certain embodiments, the flange 310 can be designed to be a cylindrical shell surrounding and extending from the female connector device 150. Other flange designs and solutions are also possible.

Consistent with various embodiments, the electrical connector system can include a pumping mechanism 312 that can be configured to remove the air from the electrical connector system. For example, in certain embodiments, the pumping mechanism 312 can be located on the storage compartment 304, and can extract the air from the electrical connector system in order to create a vacuum environment after the male connector device has fully coupled with the female connector device 150. In certain embodiments, there can be one or more pumping mechanisms 312 that can be configured to force air out of the electrical connector system while injecting nitrogen. Certain embodiments are directed toward the use of a passive exit point that allows air to exit while the corrosion deterring fluid 106 is added using refill port 302.

Figure 4:
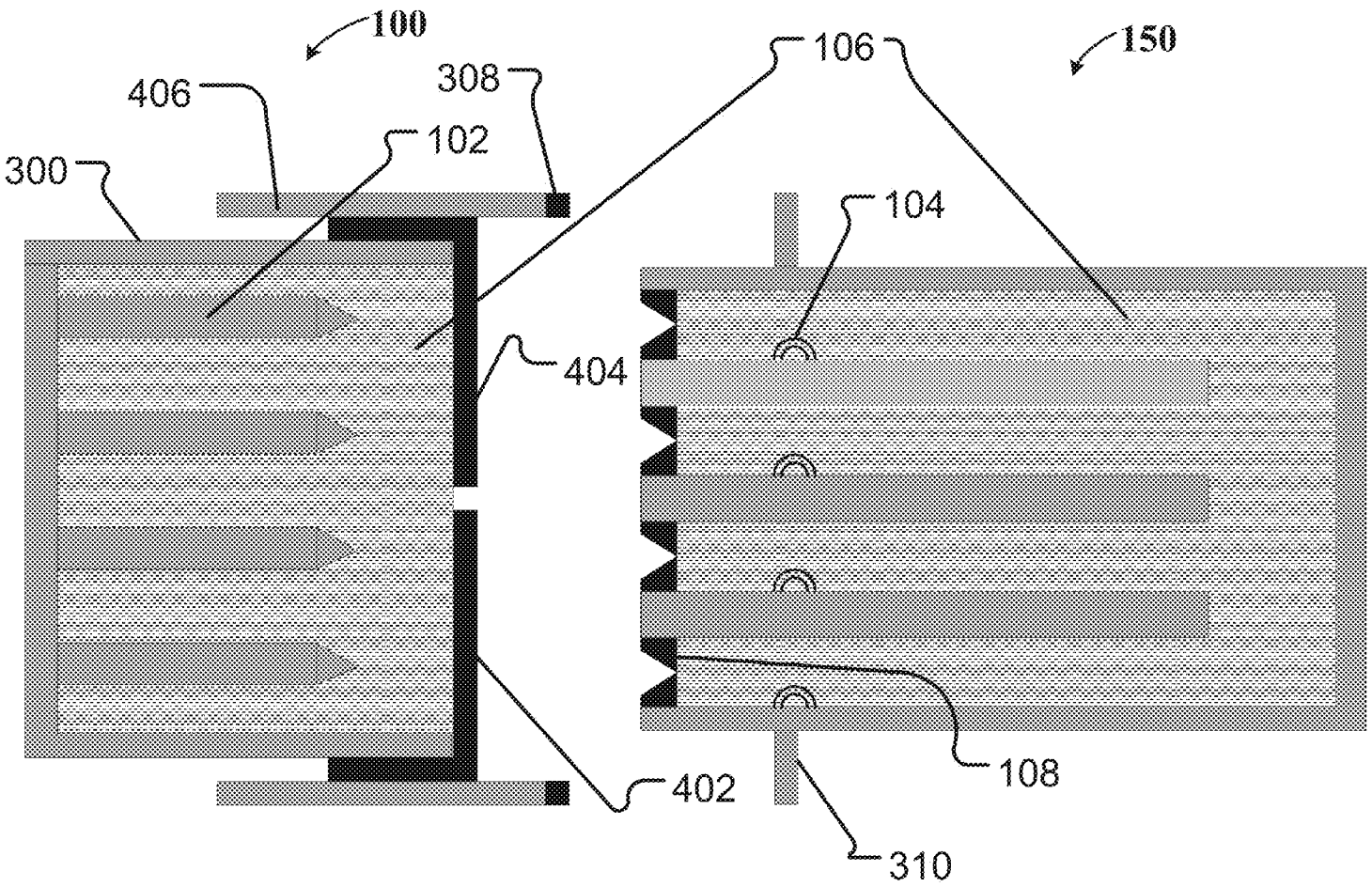
FIG. 4 is a side view of a male connector device and female connector device of an electrical connector, consistent with embodiments of the present disclosure.

FIG. 4 is a side view of a male connector device 100 and a female connector device 150 of an electrical connector in an uncoupled state, consistent with embodiments of the present disclosure. Aspects of FIG. 4 are directed toward an electrical connector system that can contain a corrosion deterring fluid 106 in both a female connector device 150 as well as in a male connector device 100. In this way, it can be possible to maintain a protective environment for the male connector device 100 and the female connector device 150 even when kept separately in an uncoupled state. Further, this configuration can be particularly useful for avoiding the dilution of the corrosion deterring fluid 106 by air or other substances. For instance, leakage between the male and female connector devices will not result in substantial dilution if both connector devices contain high levels of the corrosion deterring fluid 106.

The male connector device 100 can include a first sealing membrane segment 402 and a second sealing membrane segment 404, composed of a deformable material that allows the connecting members 102 to penetrate through while impeding leakage of the corrosion deterring fluid 106. Similarly, the female connector device 150 can include an arrangement of sealing gates 108 composed of a deformable material that allows the connecting members 102 to be inserted into the female connector device 150 and interface with the electrical contacts 104.

Consistent with various embodiments, the male connector device outer casing 300 can be surrounded by an external housing 406. The outer casing 300 and external housing 406 can be configured to move or slide relative to each other and between a default position and a fully engaged position. Further, in certain embodiments, the first sealing membrane segment 402 and the second sealing membrane segment 404 can be designed to move relative to the outer casing 300 and the external housing 406. In certain embodiments, when the outer casing 300 and external housing 406 are in the default position, the first sealing membrane segment 402 and the second sealing membrane segment 404 can be seated tightly against one another so as to form an airtight seal that can impede the leakage of the corrosion deterring fluid 106. When the male connector device 100 couples with the female connector device 150, the outer casing 300 and the external housing 406 can move to the fully engaged position, and the first sealing membrane segment 402 and the second sealing membrane segment 404 can separate to allow for passage of the connecting members 102 to interface with the electrical contacts 104.

Consistent with various embodiments, the male connector device outer casing 300 can be equipped with a sealing gasket 308 configured to interface with a flange 310 extending from and surrounding the female connector device 150 to create a seal, that in some embodiments is airtight, when the male connector device 100 is fully coupled with the female connector device 150.

Consistent with various embodiments, when the electrical connector system is in its uncoupled, or default state, the outer casing 300 of the male connector device 100 can be recessed relative to the external housing 406, and the first sealing membrane segment 402 and second sealing membrane segment 404 can be seated tightly together to impede leakage of the corrosion deterring fluid 106. In this default position, the connecting members 102 can be maintained in the protective environment facilitated by the corrosion deterring fluid 106. Further, the extension of the external housing 406 relative to the outer casing 300 can allow the sealing gasket 308 to interface with the flange 310 and form a hermetic seal before the first sealing membrane segment 402 and the second sealing membrane segment 404 separate. This configuration can be particularly useful for avoiding leakage of the corrosion deterring fluid 106 as the male connector device 100 and the female connector device 150 couple and uncouple.

Consistent with various embodiments, the male connector device 100 can be coupled with a female connector device 150. The external housing 406 can extend forward relative to the outer casing 300 to make contact with the flange 310, and form an airtight seal between the sealing gasket 308 and the flange 310. Once this seal has been created, the outer casing 300 can move forward, and the connecting members 102 can push against the first sealing membrane segment 402 and the second sealing membrane segment 404, causing them to separate and retract against the outer housing 300. In this fully engaged position, the seal formed by the sealing gasket 308 and the flange 310 impedes the leakage of the corrosion deterring fluid. With the first sealing membrane segment 402 and the second sealing membrane segment 404 separated, the connecting members 102 can then be inserted through the sealing gates 108 of the female connector device 150 to interface with the electrical contacts 104. The electrical connector system can remain in this state throughout the duration of its operation.

Consistent with various embodiments, the male connector device 100 can be decoupled from the female connector device 150. While the sealing gasket 308 and flange 310 are still in the fully engaged position, the outer casing 300 can draw back from the female connector device 150. As the connecting members 102 withdraw through the sealing gates 108, the first sealing membrane segment 402 and the second sealing membrane segment 404 can return to their sealed default position. With this seal in place, the male connector device 100 and female connector device 150 can then be decoupled while limiting loss of the corrosion deterring fluid 106.

Figure 5:
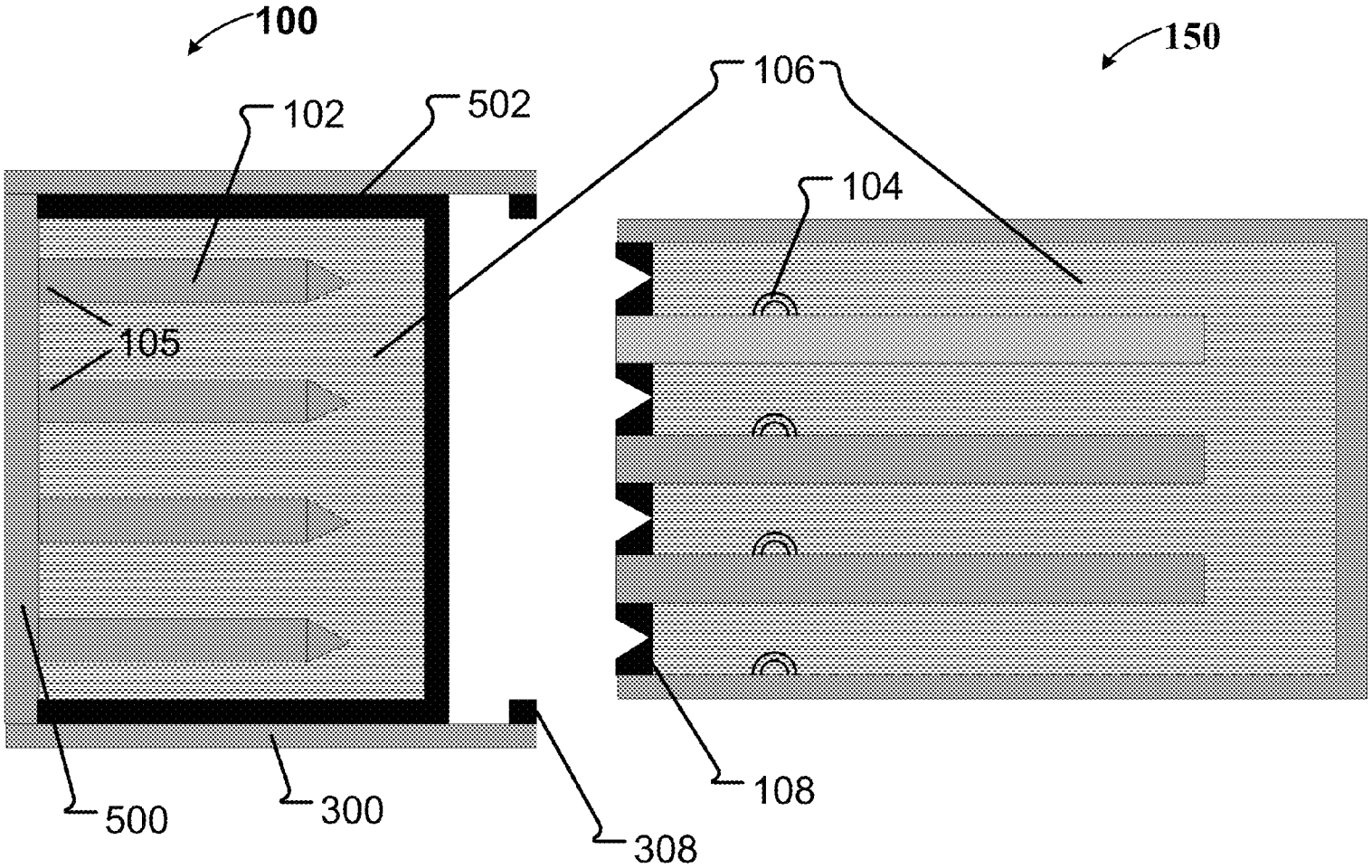
FIG. 5 is a side view of the male connector device and female connector device of the electrical connector, consistent with embodiments of the present disclosure.

FIG. 5 is a side view of the male connector device 100 and female connector device 150 of the electrical connector in an uncoupled state, consistent with embodiments of the present disclosure. Aspects of FIG. 5 are directed toward an electrical connector system that can contain a corrosion deterring fluid 106 in both a female connector device 150 as well as in a male connector device 100. The male connector device 100 can include a sealing membrane 502 composed of a deformable material that allows the connecting members 102 to penetrate through while deterring leakage of the corrosion deterring fluid 106. Similarly, the female connector device 150 can include an arrangement of sealing gates 108 composed of a deformable material that allows the connecting members 102 to be inserted into the female connector device 150 and interface with the electrical contacts 104.

Consistent with various embodiments, the male connector device outer casing 300 can be extended relative to the connecting members 102 and the sealing membrane 502. In certain embodiments, the male connector device 100 can include a movable rear wall 500 that is designed to move independently of the male connector device's outer casing 300, and the connecting members 102 can be affixed at one end (i.e. the proximal end 105) to the rear wall 500. In certain embodiments, the outer casing 300 can be equipped with a sealing gasket 308 that can be configured to fit tightly against the female connector device 150 to create an airtight seal when the male connector device 100 and female connector device 150 are fully coupled.

When the male connector device 100 couples with the female connector device 150, the sealing gasket 308 can form a hermetic seal with the female connector device 150. Once this seal has been formed, the rear wall 500 can move forward, allowing the connecting members 102 to penetrate through the sealing membrane 502 and be inserted through the sealing gates 108 to interface with the electrical contacts 104. The electrical connector system can remain in this state throughout the duration of its operation.

Consistent with various embodiments, the male connector device 100 can be decoupled from the female connector device 150. While the hermetic seal is still in place between the sealing gasket 308 and the female connector device 150, the rear wall 500 can draw backwards, withdrawing the connecting members 102 through the sealing gates 108 and the sealing membrane 502. Once the connecting members 102 have withdrawn to their original position, the outer casing 300 can also draw back to its original position. This configuration can be particularly useful for avoiding loss or dilution of the corrosion deterring fluid 106 in the process of coupling and uncoupling the male connector device 100 and the female connector device 150.

Although the present disclosure has been described in terms of specific embodiments, it is anticipated that alterations and modifications thereof will become apparent to those skilled in the art. Therefore, it is intended that the following claims be interpreted as covering all such alterations and modifications as fall within the true spirit and scope of the disclosure.

What is claimed is:

1. A female connector device comprising:

a plurality of walls defining a chamber containing a corrosion deterring fluid and designed to couple with a male connector device;

one or more electrical contacts within the chamber and configured to interface with connecting members of the male connector device;

one or more sealing gates configured to act as a sealing membrane that is designed to separate the corrosion deterring fluid in the chamber from fluid external to the chamber while allowing the connecting members of the male connector device to be inserted through the gates and into the chamber; and a pumping mechanism configured to remove air from the chamber after the male connector device has fully coupled with the female connector device.

2. The device of claim 1, wherein the one or more sealing gates are configured to deform, allowing for penetration by connecting members of the male connector device and forming a hermetic seal that impedes leakage of the corrosion deterring fluid.

3. The device of claim 1, wherein support scaffolding upholds the electrical contacts, and the support scaffolding is configured to guide the connecting members to the one or more electrical contacts.

4. The device of claim 1, wherein the female connector device includes a separate storage compartment in which the corrosion deterring fluid is held, and a valve affixed to the storage compartment, the valve configured to actuate when the female connector device interfaces with the male connector device and to release the corrosion deterring fluid.

5. The device of claim 4, wherein the separate storage compartment includes a refill port that is configured to open in response to connection of an external supply of the corrosion deterring fluid, thereby facilitating repletion of the storage compartment.

6. The device of claim 1, wherein the corrosion deterring fluid is selected from the group consisting of helium, neon, argon, xenon, krypton and nitrogen.

7. The device of claim 1, wherein the corrosion deterring fluid is nitrogen.

8. The device of claim 1, wherein the one or more sealing gates comprise a guide notch configured to direct the connecting members of the male connector device to the one or more electrical contacts.

9. A male connector device comprising:

an outer casing configured to enclose a chamber containing a corrosion deterring fluid and to couple with a female connector device, the outer casing comprising a plurality of walls that include a rear wall;

one or more connecting members having a proximal end and a distal end, the proximal end attached to the rear wall of the outer casing, and the one or more connecting members being of a length such that the distal end is recessed relative to at least one of the walls of the outer casing; and one or more sealing membranes that are designed to separate the corrosion deterring fluid in the chamber from fluid external to the chamber while allowing the one or more connecting members to be inserted into the female connector device;

wherein the proximal end and the distal end of each of the one or more connecting members are both located within the corrosion deterring fluid of the chamber when the male connector device is in an uncoupled state.

10. The device of claim 9, wherein the one or more sealing membranes are configured to deform, allowing the one or more connecting members to pass through the one or more sealing membranes and into the female connector device, and surround the one or more connecting members in a sealing engagement to impede the corrosion deterring fluid from exiting either the male connector device or the female connector device.

11. The device of claim 9, wherein the rear wall of the outer casing is configured to move relative to another of the walls of the outer casing.

12. The device of claim 9, wherein the male connector device is surrounded by an external housing configured to move relative to the outer casing between a default position and a fully engaged position.

13. The device of claim 12, wherein the one or more sealing membranes are composed of a pair of segments designed to slide relative to the external housing and the outer casing, and configured so as to form a hermetic seal in the default position, and to be separated to allow passage of the one or more connecting members in the fully engaged position.

14. An electrical connector system comprising:

a female connector device including:

a plurality of walls enclosing a first chamber containing a corrosion deterring fluid, one or more electrical contacts within the first chamber, and one or more sealing gates configured to act as a sealing membrane, the one or more sealing gates separating the corrosion deterring fluid in the first chamber from fluid external to the first chamber; and a male connector device designed to couple with the female connector device, the male connector device including:

an outer casing configured to enclose a second chamber containing a corrosion deterring fluid, the outer casing comprising a plurality of walls that include a rear wall, one or more connecting members having a proximal end and a distal end, the proximal end attached to the rear wall of the outer casing, the one or more connecting members being of a length such that the distal end is recessed relative to at least one of the walls of the outer casing, and the one or more connecting members configured to be inserted through the one or more sealing gates and into the first chamber to interface with the one or more electrical contacts of the female connector device, and one or more sealing membranes separating the corrosion deterring fluid in the second chamber from fluid external to the second chamber while allowing the one or more connecting members to be inserted into the female connector device, wherein the proximal end and the distal end of each of the one or more connecting members are both located within the corrosion deterring fluid of the second chamber when the male connector device is not coupled to the female connector device.

15. The connector system of claim 14, wherein the one or more sealing gates and the one or more sealing membranes are configured to deform, allowing the one or more connecting members to pass through the one or more sealing membranes and the one or more sealing gates into the female connector device, and surround the one or more connecting members in a sealing engagement to impede the corrosion deterring fluid from exiting either the male connector device or the female connector device.

16. The connector system of claim 14, wherein the one or more connecting members and the one or more electrical contacts are adapted for electrical communication.

* * * * *